US010490044B2

(12) United States Patent
Lavery et al.

(10) Patent No.: US 10,490,044 B2
(45) Date of Patent: Nov. 26, 2019

(54) ANTI-FRAUD SECURITY TAG REMOVAL

(71) Applicant: SYMBOL TECHNOLOGIES, LLC, Lincolnshire, IL (US)

(72) Inventors: Richard J. Lavery, Huntington, NY (US); Russell Calvarese, Stony Brook, NY (US); Rehan K. Jaffri, New York, NY (US); David Bellows, Old Westbury, NY (US); Sean Connolly, Stony Brook, NY (US)

(73) Assignee: Symbol Technologies, LLC, Holtsville, NY (US)

( * ) Notice: Subject to any disclaimer, the term of this patent is extended or adjusted under 35 U.S.C. 154(b) by 0 days.

(21) Appl. No.: 15/841,438

(22) Filed: Dec. 14, 2017

(65) Prior Publication Data

US 2019/0188982 A1 Jun. 20, 2019

(51) Int. Cl.
*G08B 13/24* (2006.01)

(52) U.S. Cl.
CPC ..... *G08B 13/2434* (2013.01); *G08B 13/246* (2013.01)

(58) Field of Classification Search
CPC ..... G08B 13/2434; G08B 13/246; G08B 13/2402; G08B 13/2417; G08B 21/0275; E05B 73/0017; G06K 19/045; G06K 19/0723; G06K 19/0776
USPC ..... 340/572.1
See application file for complete search history.

(56) References Cited

U.S. PATENT DOCUMENTS 9,460,597 B1 * 10/2016 Clark ..... G08B 13/2454
9,978,236 B2 * 5/2018 Casanova ..... E05B 73/0047
2009/0229327 A1 * 9/2009 Valade, Jr. ..... E05B 73/0017 70/277
2009/0237219 A1 * 9/2009 Berlin ..... G08B 13/246 340/10.6
2014/0091933 A1 * 4/2014 Mohiuddin ..... G08B 13/246 340/572.1
2014/0253333 A1 * 9/2014 Patterson ..... E05B 73/0064 340/572.4
2015/0029027 A1 * 1/2015 Marin Villamayor ..... G08B 13/2465 340/572.1
2017/0178479 A1 * 6/2017 Ellers ..... G08B 13/2434

* cited by examiner

*Primary Examiner* — Hirdepal Singh
(74) *Attorney, Agent, or Firm* — Yuri Astvatsaturov

(57) ABSTRACT

An anti-fraud security tag removal system reads product identifiers on groups of items presented for purchase at a point of sale area. The product identifiers indicate how many of the items include security tags that must be removed. A security tag detacher removes security tags only on items for which the system has detected that the item was present, preventing removal of security tags on items which were not read by the point of sale system. An RF antenna and a security tag detacher are co-located such that the product identifier of the item is highly likely to be read when a sales clerk removes the security tag. The product identifier may be incorporated into the security tag and disabled when the security tag is attached to the item. The product identifier may be shunted by the security tag.

17 Claims, 5 Drawing Sheets

ANTI-FRAUD SECURITY TAG REMOVAL

BACKGROUND OF THE INVENTION

Retail sales operations usually incur losses due to stolen merchandise. High-value items in particular are vulnerable to theft. Accordingly, retail operators sometimes attach a security tag to high value items, such as a piece of clothing. If a would-be thief moves an item with a security tag past a security gate near an exit of the retail sales environment, then a security alert may sound to indicate to retail personnel that the item has not been purchased.

When a customer presents an item with a security tag at a point-of-sale area, a sales clerk may remove the security tag(s) at the time of purchase. In some cases, however, a retail sales clerk may cooperate with a thief in a so-called "sweetheart" arrangement wherein the sales clerk removes the security tag without the customer purchasing the item. Security tags may thus fail to prevent theft.

Accordingly, there is a need for a more secure security tag arrangement for preventing theft and fraud in retail sales environments.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
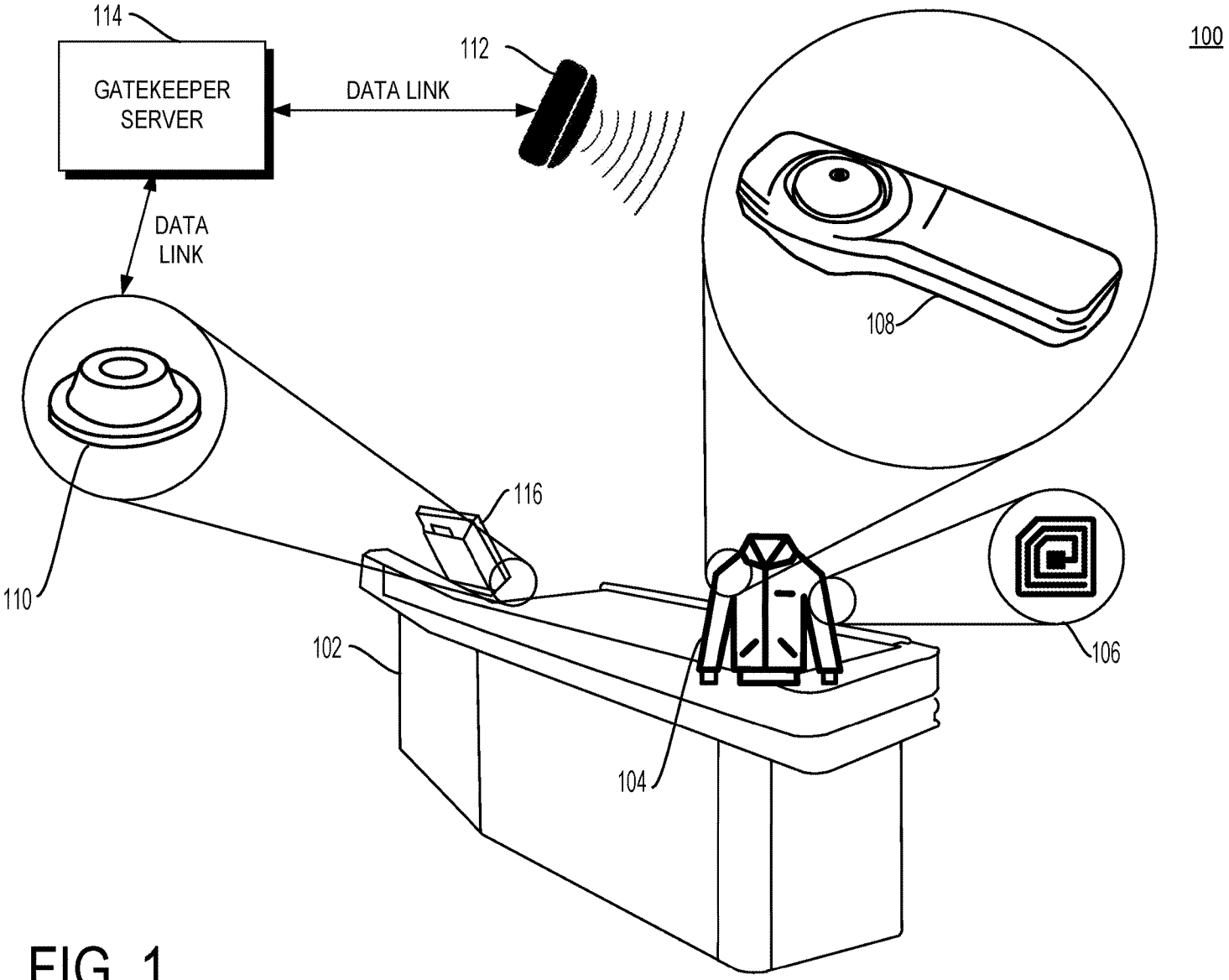
FIG. 1 is a schematic diagram of a point-of-sale area in a system with anti-fraud security tag removal in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

In some implementations, a method of removing a security tag from a physical article is provided. The method includes receiving, at a security tag detacher, a request to remove a security tag from the physical article at a point-of-sale area. The method further includes detecting, by a radio-frequency (RF) antenna at the point of sale-of-sale area, the presence of a radio frequency identification (RFID) tag, the RFID tag having an identifier associated with the physical article. The method includes determining whether the identifier associated with the physical article satisfies a detachment condition. The method further includes releasing the security tag, by the security tag detacher, when the physical article satisfies the detachment condition.

In some implementations, a system for detaching a security tag is provided. The system includes a physical article detector configured to confirm the presence of a physical article at a point-of-sale area based on an identifier of the physical article. The system includes a security tag gatekeeper configured to receive the identifier of the physical article from the physical article detector, the security tag gatekeeper further configured to determine whether the physical article satisfies a security tag detachment condition based on the identifier of the physical article. The system further includes a security tag detacher at the point-of-sale area, the security tag detacher configured to receive a request to detach the security tag from the physical article and to detach the security tag if the physical article satisfies the detachment condition.

In some implementations, a system for detaching a security tag is provided and that system includes a radio-frequency (RF) antenna configured to confirm the presence of a physical article at a point-of-sale area based on a radio-frequency identification (RFID) tag attached to the physical article. The system further includes a security tag detacher, the security tag detacher being co-located with the RF antenna at the point-of-sale area, and the security tag detacher being further configured to detach a security tag from the physical article.

FIG. 1 is a schematic diagram of a point-of-sale device 102 in a system 100 with anti-fraud security tag removal in accordance with some embodiments. In some implementations, the point-of-sale device 102 is positioned in a checkout area proximate to a retail sales floor where customers may purchase items for sale, such as item 104. The point of sale device 102 may include a counter onto which customers may present items to be purchase, a cash register, a terminal 116, a security tag detacher 110. In other implementations, the system 100 for anti-fraud security tag removal includes a presentation area that is not a point-of-sale area. Instead, the presentation area may include an area where a person or thing presents items to be inventoried, counted, entered into a ledger, and/or logged (e.g., a return counter, a manufacturing environment, an assembly line, the output of a machine, an inventory manager, etc.).

In implementations, item for sale 104 includes a radio-frequency identification (RFID) tag 106 embedded therein or thereon. The RFID tags 106 can be detected by an RF antenna 112 disposed proximate to the point-of-sale device 102. The RFID tags 106 may include information regarding the items for sale 104, for example without limitation security information, UPC code, manufacturer information, distribution information, information regarding the contents of the items for sale 104, etc. Security information stored in the RFID tag 106 may include whether the item 104 includes one or more security tags.

Information in the RFID tag 106 may be read and detected by the point-of-sale device 102 and/or other components of the system 100, including components not shown in FIG. 1, such as the radio-frequency (RF) antenna 112. The RF antenna 112 may be driven at a power level sufficient to detect RFID tags on items presented for sale at the point-of-sale device 102. The farther from the point-of-sale device 102 the RF antenna is located, the more power the RF antenna will likely need to be able to consistently read RFID tags on items presented for sale. The RF antenna is further in communication with a gatekeeping server 114. Any information detected at the RF antenna by reading RFID tags may be communicated to the gatekeeping server 114 for use by other components of the system 100.

The point of sale device 102 further includes a security tag detacher 110. The security tag detacher 110 may be of a type that is compatible with the type of the security tag 108 such that the detacher 110 may remove the security tag 108 from the item 104. In some implementations, the detacher 110 removes the security tag 108 from the item 104 when a clerk or other person inserts the security tag 108 into the detacher 110. The detacher 110 may include an electronically controllable release actuation mechanism. In some examples, the detachers herein include a processor and a memory storing executable instructions to affect electronic actuation in response to received release signals. In some examples, the detachers have included therein an RF transmitter or other wireless transmitter to receive release signals.

When the security tag 108 is inserted into the detacher 110, a determination is made whether the detacher 110 should release the security tag 108. In one implementation, the gatekeeping server 114 determines whether the security tag 108 should be detached and transmits a signal to the detacher 110 indicating whether the detacher 110 should operate. In some implementations, the detacher 110 receives the signal from the gatekeeping server 114 and automatically and electronically releases the security tag 108. The gatekeeping server may base the determination on information about the items presented for purchase at the point of sale device 102 that was read from the RFID tag 106 by the RF antenna 112 and communicated over a data link to a gatekeeping server 114. In particular, the gatekeeping server may include a product table indicating which items displayed for sale on the retail sales floor proximate to the point of sale device 102 are associated with security tags. For example, items displayed for sale on the retail sales floor may each have UPC codes detected by the RF antenna 112 and available to the gatekeeping server 114. A lookup table on the gatekeeping server 112 correlating UPC codes to security tags may be referenced to determine whether an item with a security tag has been detected at the point-of-sale device 102. A key benefit of the gatekeeping server 114 signaling the detacher 110 to operate only if an item 104 with a security tag has been detected by the RF antenna is that clerks may not erroneously release a security tag with the detacher 110 unless the system has recorded (e.g., in a transaction log) that the item 104 was present at the point-of-sale device 102.

Often a customer will present multiple items at the point of sale device 102 at the same time. Fewer than all of the items may include security tags. If the system detects the items presented at the point of sale device 102 via the RF antenna, then the RFID tags are likely to be read all at the same time or near the same time. As such, the gatekeeping server 114 may receive information on the items presented for purchase as a group. If the items are manually singulated at the point of sale device 102 (e.g., by a sales clerk for bagging), then removal of security tags may be done in a serial fashion. In such a case, the gatekeeping server 114 may receive a request to remove a security tag and may grant the request a number of times up to the number of items read by the RF antenna that are associated with security tags. As an example, if a customer presents ten items for purchase at the point of sale device 102 and the gatekeeper server 114 determines that three of the items include security tags, then the gatekeeper server 114 may grant three requests from the detacher 110 during a purchasing session associated with the customer. If the gatekeeper server 114 receives a fourth request from the detacher 110 to release a security tag during the purchasing session associated with the customer, then there is a mismatch condition between the number of expected and actual security tag release requests. Such a mismatch suggests that not all items presented for purchase at the point of sale device were read by the RF antenna. If such a condition exists, the gatekeeper server 114 may decline any further security tag release requests from the detacher 110, signal for retail staff to investigate, request that retail staff position the presented items with respect to the RF antenna such that any missed tags are read, etc.

In another implementation, the detacher 110 may itself include a security tag lookup table, and may receive information regarding the item 104 via the RF tag or via other means. In one example, the terminal 116 includes a symbolic barcode scanner and the item 104 includes a symbolic barcode with UPC information. The detacher 110 may reference product lookup table information received from the terminal 116 to determine whether it should release a security tag. In one implementation, the barcode scanner is incorporated into the detacher 110 and the barcode is positioned on the security tag 108 such that the detacher 110 scans the barcode when the security tag 108 is inserted into the detacher 110.

Figure 2:
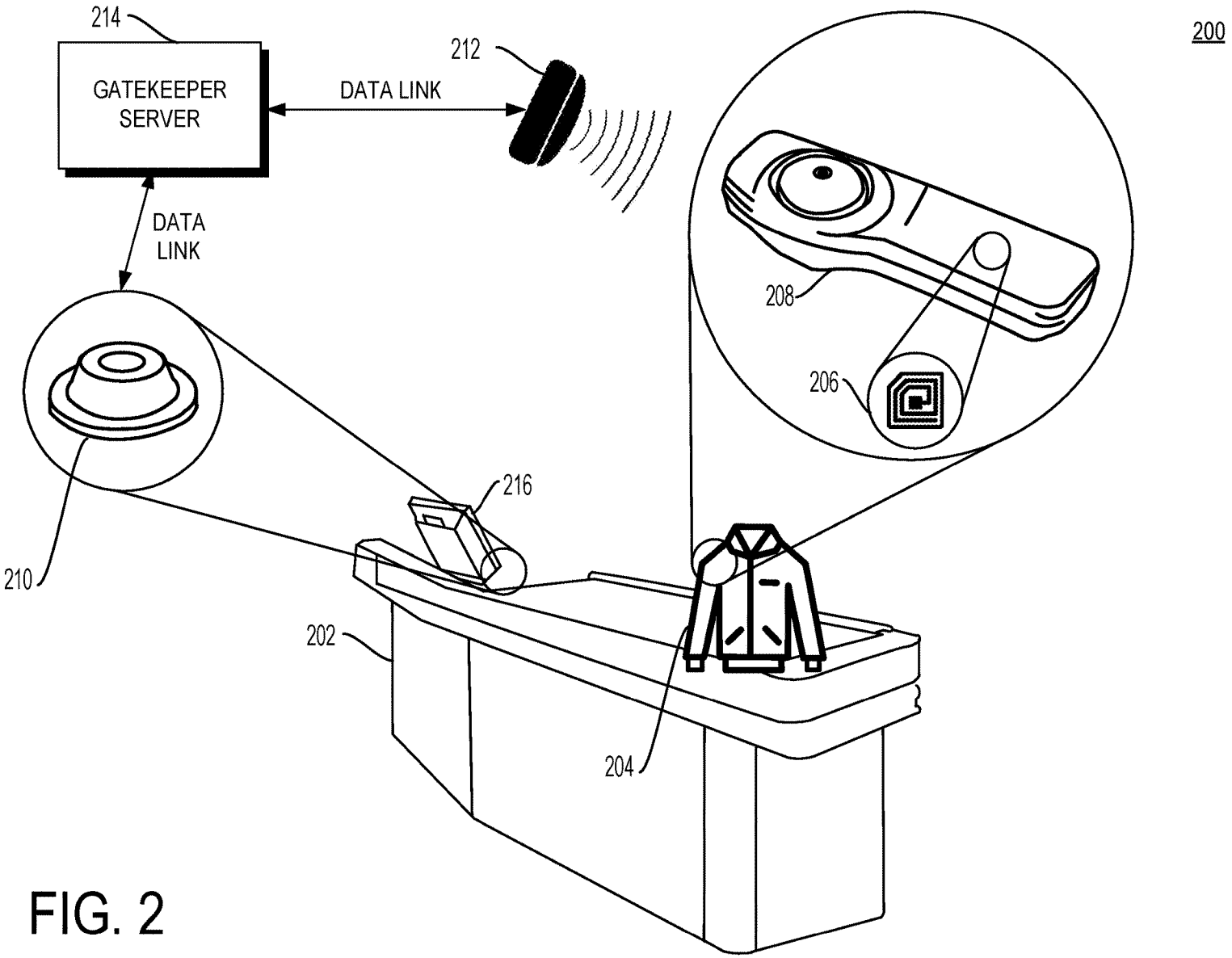
FIG. 2 is another schematic diagram of a point-of-sale area in a system with anti-fraud security tag removal in accordance with some embodiments.

FIG. 2 is another schematic diagram of a point-of-sale device 202 in a system 200 with anti-fraud security tag removal in accordance with some embodiments. In the implementation illustrated in FIG. 2, an RFID tag 206 is incorporated into a security tag 208 attached to an item 204 presented for purchase at the point of sale device 202. The point of sale device 202 includes a security tag detacher 210 and a terminal 216. The RFID tag 206 is incorporated into the security tag 208. In an example, the RFID tag 206 may be readable by the RF antenna 212. In an implementation, the gatekeeper server 214 sends a signal to the security tag detacher 210 which automatically and electronically releases the security tag 208 from the item 204.

In another example, the security tag 208 may include a shunt that shorts the RFID tag 206, making the RFID tag initially unreadable by the RF antenna 212, until the shunt is removed. For example, although not shown in FIG. 2, in an example, the RFID tag 206 may be located on the item 204 and the security tag 208 may be separately located on the item 204, but electrically connected to the RFID tag 206. When the security tag 208 is detached from the item 204, for example, in response to the security tag detacher 210 receiving a release signal from the gatekeeper server 214 and automatically and electronically releasing the security tag 208, a shunt between the RFID 206 and the security tag 208 is removed and the RFID tag 208 becomes readable by the RF antenna 212. While in some examples, the security tag 208 is electrically connected to the RFID tag 206, in other examples, a capacitive shunt may be used between the security tag 208 and the RFID tag 206. For example, the RFID tag 206 may be positioned on the item 204 and the security tag 208 may be positioned on top of that RFID tag 206 and engaged on the item 204 forming a capacitive shunt between the RFID tag 206 and the security tag 208. Upon receiving a release signal from the gatekeeper server 214, the security tag detacher 210 may automatically and electronically release the security tag 208 thereby removing the capacitive shunt between the RFID tag 206 and the security tag 208. In any event, as described, in some examples, a shunt is removed when a security tag is electrically or capacitively separated from an RFID tag, thereby making the RFID tag readable.

Figure 3:
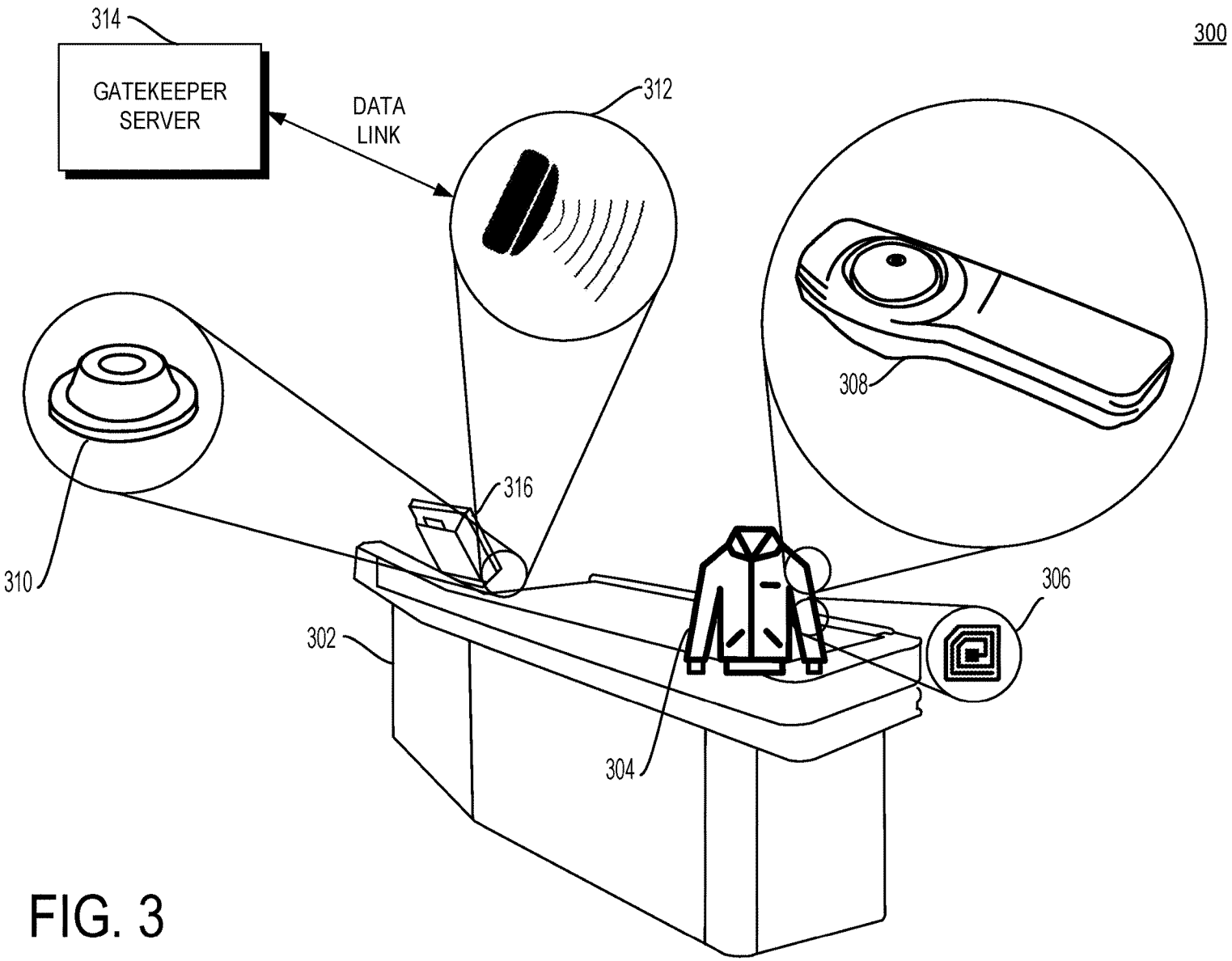
FIG. 3 is a schematic diagram of a point-of-sale area in a system with anti-fraud security tag removal including a co-located RF antenna in accordance with some embodiments.

FIG. 3 is a schematic diagram of a point-of-sale area in a system 300 with anti-fraud security tag removal including an RF antenna 312 co-located with a security tag detacher 310 in accordance with some embodiments. The RF antenna 312 has an effective range depending on the power level at which it is driven. Higher power levels will increase the range of the RF antenna 312, but could cause the RF antenna 312 to read RFID tags that are not presented at the point of sale device 302 (e.g., RFID tags that are presented at nearby point of sale devices, "environmental" RFID tags that are associated with a retail display and not presented for purchase, RFID tags on items that have been discarded, etc.).

Relatively lower power levels of the RF antenna 312 may avoid reading unwanted RFID tags, but may fail to read RFID tags presented at the point of sale device 302. A relatively lower power level of the RF antenna 312 further creates a zone of coverage around which a would-be thief (and/or retail staff attempting to assist the thief with a "sweetheart" deal) might attempt to pass the item 304 such that the RFID tag 306 of the item 304 is never detected by the RF antenna. The clerk may also physically move the detacher 310 outside the coverage zone of the RF antenna 312 such that the security tag 308 may be safely removed without alerting the system 300 that the item 304 had been through the point of sale area and left the retail sales floor without the customer paying.

To counter this strategy, the RF antenna 312 and the detacher 310 may be co-located such that any attempt to remove the security tag 308 would require the retail staff member to place the item 304 and its associated RFID tag 306 inside the coverage zone of the RF antenna 312, thus ensuring that the RFID tag 306 is read and recorded in a transaction log of items presented at the point of sale device 302 in connection with a checkout session. In the implementation illustrated in FIG. 3, the gatekeeper server 314 need not communicate with the detacher 310 because the system 300 relies on the close proximity of the detacher 310 to the RF antenna 312 to ensure successful RFID reads when a security tag 308 is removed.

In one implementation, the detacher 310 is secured to its position on the point of sale device 302 such that a sales clerk may not move the detacher 310 outside of the zone covered by the RF antenna 312 to remove the security tag without triggering a read of the RFID tag 306 by the RF antenna 312.

In another implementation, the security tag 308 and the RFID tag 306 are attached to the item 304 and include a shunt between the two that shorts the RFID tag 306, while the security tag 308 is attached to the item 304, making the RFID tag unreadable by the RF antenna 312. When the security tag 308 is detached from the item 304, the shunt is removed and the RFID tag 308 becomes readable by the RF antenna 312. Shunting the RFID tag 306 in the system 300 wherein the RF antenna 312 and the detacher 310 are co-located reduces the rate of undesired tag reads because the RFID tag 306 is unlikely to be read by nearby point of sale devices due to its inoperative nature caused by the shunt. In this example, the RFID tag 306 becomes operative only when the shunt is removed by the detacher 310. Despite having a shorter period of operability compared to an RFID tag without a shunt, the RFID tag 308 is nonetheless likely to be read by the RF antenna 312 due to co-location with the detacher 310. Due to the increased likelihood of obtaining a read on the RFID tag 306 due to the co-location with the RF antenna, the RFID tag 306 may be discarded by retail staff personnel in a receptacle (e.g., an RF shielded receptacle) at the point of sale device 302 after the security tag has been detached, thus further reducing the likelihood of an undesired RFID tag read.

Proximity between the co-located RF antenna 312 and detacher 310 depends on the power driving the RF antenna. In one implementation, the RF antenna and the detacher are spaced approximately six inches apart. Suitable power levels for the RF antenna will depend on the transmitted power of the radio and the gain of the transmitter antenna, and, as such, the suitable power levels and distance ranges may vary.

Figure 4:
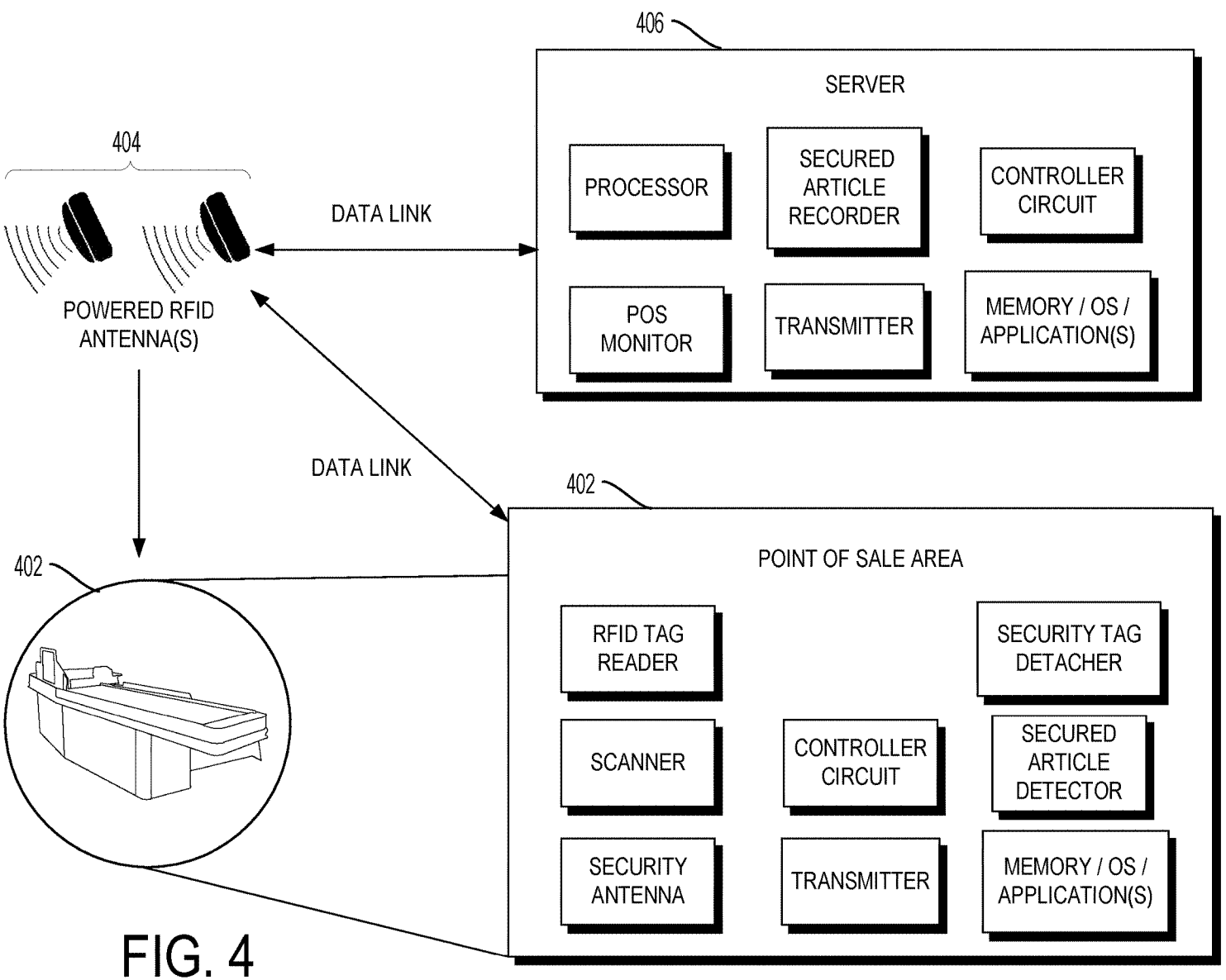
FIG. 4 is a block diagram of a point-of-sale area and a gatekeeping server in a system with anti-fraud security tag removal.

FIG. 4 is a block diagram of a point-of-sale area 402 and a gatekeeping server 406 in a system 400 with anti-fraud security tag removal. The point of sale device 402 includes components for reducing fraud in connection with removal of security tags in a retail sales environment where customers present items for purchase at the retail sales device 402.

Some components of the point of sale device 402 are directed toward detecting items presented for sale, extracting information about the items (e.g., UPC code), and recording the items in a transaction log such that any items that were not paid for can be identified. One component for detecting the products for sale is the RFID tag reader. The RFID tag reader may be an RF antenna driven by the controller circuit and operable to read RFID tags on items within range of the antenna. Another component for detecting items presented for sale is the scanner, which may be a symbolic barcode scanner at a terminal, on a security tag detacher, integrated into a surface of the device 402, etc. Items with symbolic barcodes may be thus scanned and information recorded regarding the items in the transaction log. The point of sale device 402 may include a security antenna for detecting security tags that pass through a zone such as an egress from the retail sales floor (e.g., indicating the item may not have been purchased).

The point of sale device 402 includes a controller circuit, a transmitter, and a memory running an OS and/or applications. The controller circuit may receive information from other components of the device 402 such as item data from items detected by the RFID tag reader, the scanner, the security antenna, etc. The controller may transmit via the transmitter the item data to the gatekeeping server 406, the applications stored in memory, etc. In one implementation, the controller circuit may send control signals to the security tag detacher to permit or disallow release of a security tag.

In other implementations, the security tag detacher transmits a release request to the controller circuit. The controller circuit may transmit the request to the gatekeeping server 406 or to the secured article detector at the device 402 for a determination whether the security tag release request should be granted. There are several ways a secured article detector may determine whether a request to release a security tag should be granted. In one implementation, the secured article detector includes a table of items offered for sale at a retail sales floor proximate to the device 402. Each of the items offered for sale may be associated with a UPC code that is readable by the device 402 (e.g., using the scanner, RFID tag reader, etc.).

The secured article detected may receive the UPC codes of products presented at the device 402 as part of a shopping checkout session. For each received UPC code, the secured article detector may check whether the item is associated with one or more security tags. In this way, the secured article detector may determine how many security tags should be released during the checkout session based on the number of detected items. If the security tag detacher requests to release more or fewer security tags during the checkout session, then it may be concluded that there is a problem (e.g., an item with a security tag was presented by the customer but not detected by the system and therefore would not be recorded in the transaction log).

In one implementation, the secured article detector will grant (e.g., via the controller circuit) requests to release security tags during a checkout session up to the number of security tags expected to be included in the items presented for purchase during the purchasing session. In other words, additional requests to release security tags may be granted if the number of product identifiers associated with security tags is equal to or less than the number of requests already received during the purchasing session. As such, specific items with security tags are not associated with specific requests to detach security tags. In another implementation, each request to remove a security tag will be associated with a particular item (e.g., the security tag detacher includes an RFID tag reader, scanner, etc.) that can correlate the item to the detachment request. As used herein, the term detachment condition includes any of the scenarios described wherein the detacher receives a response to a request to detach a security tag granting the request.

The system 400 further includes a gatekeeping server 406. The gatekeeping server 406 includes components for cooperating with the device 402 to reduce fraud in connection with security tags. The gatekeeping server 406 includes a controller circuit, transmitter, and memory (with e.g., an OS and applications) for performing the functions described herein in connection with the other components of the system. The gatekeeping server 406 includes a POS monitor for monitoring one or more point of sale devices 402 such that one gatekeeping server can perform the functions described herein with respect to multiple point of sale devices 402. A secured article recorder may receive item information from the device 402 and record the items in a transaction log as having been presented at the device 402. The secured article recorded may further indicate the number of expected and actual security tag detachment requests received in the transaction log as well as other information regarding the checkout sessions such as whether the security antenna detected any security tags in the egress area proximate to the device 402.

The gatekeeping server may further be communicatively coupled to powered RFID antennas such that the gatekeeping server may (e.g., via the controller circuit) adjust the power driving the RF antennas for customization of a device 402 with co-located security tag detacher and RF antennas.

Figure 5:
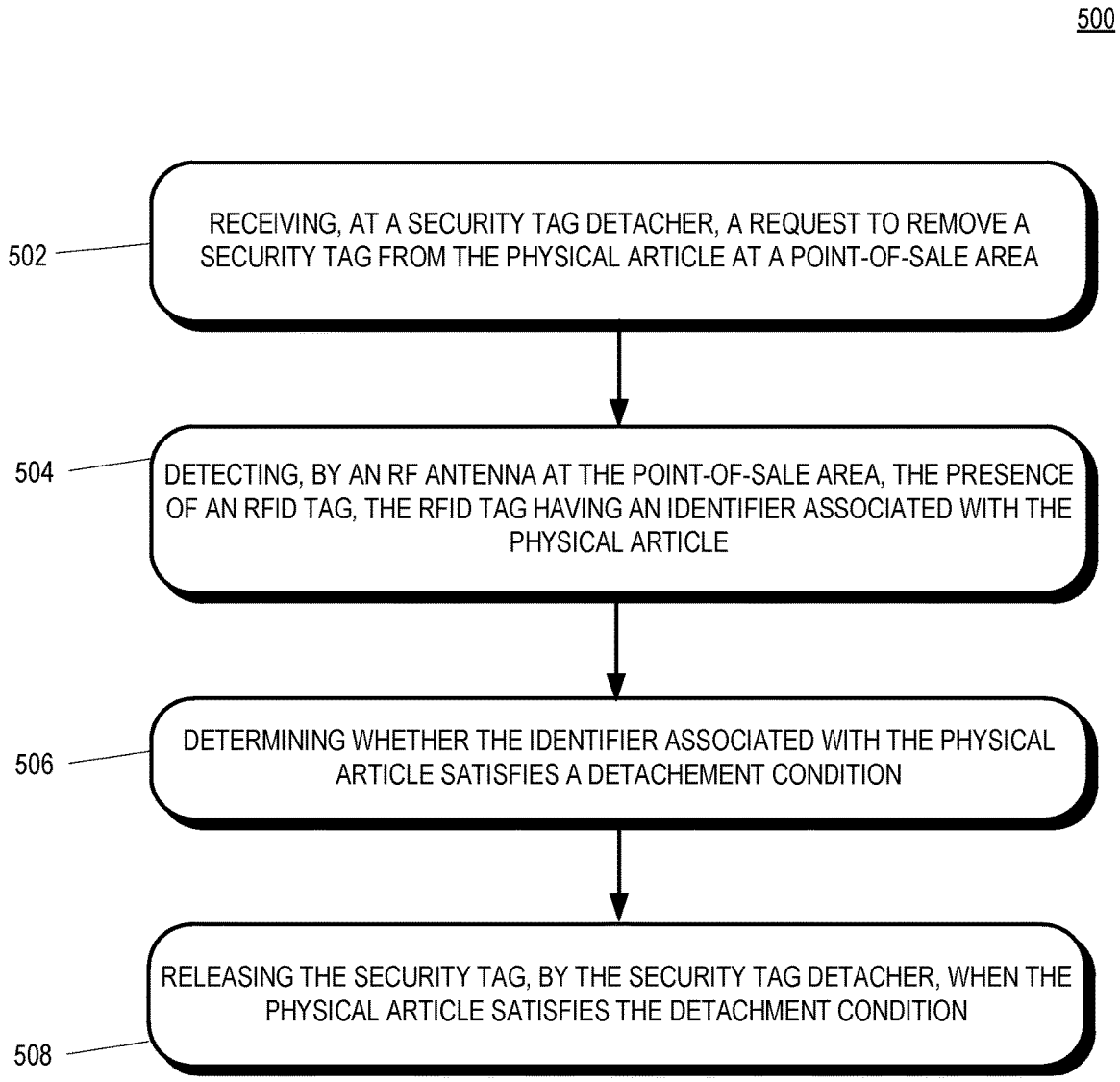
FIG. 5 is a flowchart of a method of removing a security tag from a physical article in accordance with some embodiments.

FIG. 5 is a flowchart of a method 500 of removing a security tag from a physical article in accordance with some embodiments. The method 500 includes a receiving operation for receiving, at a security tag detacher, a request to remove a security tag from a physical article at a point of sale area. The receiving operation 502 may be performed by a control circuit at a point of sale device or it may be received at a gatekeeping server for managing the point of sale device.

A detecting operation 504 detects, by an RF antenna at the point of sale area, the presence of an RFID tag, the RFID tag having an identifier associated with the physical article. The detecting operation 504 may be performed before, during, and/or after the receiving operation 502. The detecting operation 504 may include reading a UPC code from the RFID tag at the point-of-sale area.

A determining operation 506 determines whether the identifier associated with the physical article satisfies a detachment condition. The determining operation 506 may be performed by referencing a table of items (e.g., by UPC code), the table showing whether the corresponding item has a security tag (or more than one security tag). The determining operation 506 may further include recording the UPC code in a transaction log. A release operation 508 releases the security tag, by the security tag detacher when the physical article satisfies the detachment condition. The releasing operation 508 may include transmitting a request from the detacher to another component of the system, the request to operate to remove a security tag. The releasing operation 508 may further include receiving a response to the request at the detacher, the response granting the request to detach the security tag.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed:

1. A method of removing a security tag from a physical article, the method comprising:

receiving, at a security tag detacher, a request to remove a security tag from the physical article at a point-of-sale area;

detecting, by a radio-frequency (RF) antenna at the point-of-sale area, the presence of a radio frequency identification (RFID) tag, the RFID tag having an identifier associated with the physical article;

determining whether the identifier associated with the physical article satisfies a detachment condition; and releasing the security tag, by the security tag detacher, when the physical article satisfies the detachment condition, wherein the operation that determines whether the identifier associated with the physical article satisfies the detachment condition includes checking a security ledger, the security ledger indicating whether the identifier of the physical article is associated with a security tag, and wherein the security ledger indicates that the physical article is associated with more than one security tag, and wherein the security tag detacher is further configured to detach the more than one security tag from the physical article.

2. The method of claim 1, wherein the wherein the RFID tag is incorporated into the security tag.

3. The method of claim 1, further comprising: logging the physical article as having been presented at the point-of-sale area in a product transaction log.

4. The method of claim 1, wherein the operation that releases the security tag includes receiving a release signal at the security tag detacher from a security tag gatekeeper server when the identifier associated with the physical article satisfies the detachment condition.

5. The method of claim 1, wherein the detachment condition is satisfied if a number of product identifiers detected by physical article detector is equal to or less than a number of requests received by the security tag detacher during a checkout session.

6. A system for detaching a security tag, the system comprising:

a physical article detector configured to confirm the presence of a physical article at a point-of-sale area based on an identifier of the physical article;

a security tag gatekeeper configured to receive the identifier of the physical article from the physical article detector, the security tag gatekeeper further configured to determine whether the physical article satisfies a security tag detachment condition based on the identifier of the physical article; and a security tag detacher at the point-of-sale area, the security tag detacher configured to receive a request to detach the security tag from the physical article and to detach the security tag if the physical article satisfies the detachment condition, wherein the security tag gatekeeper includes a security ledger indicating whether the identifier of the physical article is associated with more than one security tag and the security tag detacher is configured to release the more than one security tag.

7. The system of claim 6, wherein the physical article detector is a radio-frequency (RF) antenna and the identifier of the physical article includes a radio-frequency identification (RFID) tag attached to the physical article.

8. The system of claim 6, wherein the request to detach the security tag from the physical article includes placing the security tag into the security tag detacher.

9. The system of claim 6, wherein the detachment condition is satisfied if a number of product identifiers detected by physical article detector is equal to or less than a number of requests received by the security tag detacher during a checkout session.

10. The system of claim 6, wherein the security tag detacher includes a control circuit configured to receive a release signal from the security tag gatekeeper when the product identifier satisfies the detachment condition, the control circuit further configured to only detach the security tag after receiving the permission signal.

11. The system of claim 6, wherein the identifier of the physical article is a symbolic barcode.

12. A system for detaching a security tag, the system comprising:

a radio-frequency (RF) antenna configured to confirm the presence of a physical article at a point-of-sale area based on a radio-frequency identification (RFID) tag attached to the physical article; and a security tag detacher, the security tag detacher being co-located with the RF antenna at the point-of-sale area, and the security tag detacher being further configured to detach a security tag from the physical article, wherein the RFID tag is inoperative when the security tag is attached to the physical article and the RFID tag is operative when the security tag is detached from the physical article.

13. The system of claim 12, wherein the security tag detacher is co-located within 6 inches of a physical article detector configured to confirm the presence of the physical article at the point-of-sale area based on an identifier of the physical article.

14. The system of claim 12, wherein the security tag includes a shunt, the shunt making the RFID tag inoperative when the security tag is attached to the physical article, and the shunt further making the RFID tag operative when the security tag is detached from the physical article.

15. The system of claim 12, wherein the RFID tag is incorporated into the security tag.

16. The system of claim 13, further comprising:

a transaction log for recording the presence of the physical article at the point-of-sale area based on the RFID tag.

17. The system of claim 12, further comprising:

a transaction log for recording the presence of the physical article at the point-of-sale area based on the RFID tag.

* * * * *